United States Patent [19]

Plunkett

[11] Patent Number: 5,011,070

[45] Date of Patent: Apr. 30, 1991

[54] DISPLAY CARTON

[75] Inventor: Robert L. Plunkett, Harrington Park, N.J.

[73] Assignee: Accurate Box Company, Inc., Paterson, N.J.

[21] Appl. No.: 447,565

[22] Filed: Dec. 7, 1989

[51] Int. Cl.[5] ..... B65D 5/42

[52] U.S. Cl. ..... 229/109; 206/45.31; 229/104; 229/161; 229/162; 229/185; 493/59; 493/160; 493/905

[58] Field of Search ..... 229/104, 109, 161, 162, 229/185; 206/45, 31; 493/59, 62, 160, 905

[56] References Cited

U.S. PATENT DOCUMENTS

| | | | |
|---|---|---|---|
| 901,695 | 10/1908 | Davis | 229/109 |
| 1,656,341 | 1/1928 | Smith | 229/161 |
| 2,021,559 | 11/1935 | Lengsfield | 229/109 |
| 2,321,473 | 6/1943 | Ferguson | 229/161 |
| 3,040,961 | 6/1962 | Meyers | 229/161 |
| 3,078,028 | 2/1963 | Skowronski | 229/161 |
| 3,089,632 | 5/1963 | Bartolucci | 229/161 |
| 4,089,417 | 5/1978 | Osborne | 229/109 |
| 4,401,255 | 8/1983 | Conroy et al. | 229/161 |
| 4,561,542 | 12/1985 | Przepiora et al. | 229/161 |
| 4,662,512 | 5/1987 | Durand | 229/161 |

*Primary Examiner*—Gary E. Elkins

*Attorney, Agent, or Firm*—Lerner, David, Littenberg, Krumholz & Mentlik

[57] ABSTRACT

A display container having a display window to display articles of manufacture held in the container is provided with at least three panels and a bottom panel which is formed from a cut-out section partially cut from one of the panels, yet remaining connected to at least one panel so that the cut-out section can be folded between the panels to form the bottom panel. A second cut-out section can be partially cut from another panel so that it remains connected to at least one panel whereby it can be folded to form a top panel for the container.

9 Claims, 10 Drawing Sheets

DISPLAY CARTON

BACKGROUND OF THE INVENTION

The present invention relates generally to cartons for packaging products, and more particularly to display cartons which are adapted to package products such that the product is exposed to the prospective purchaser thereof without having to open the carton.

In the packaging of products for retail sale, it is often desirable to have the product visible at the point of purchase. Thus, packaging containers desirably include a "window" so that the product packaged therein can be seen when the container is on the shelf at the point of purchase. This window is usually cut out of a panel or side of the container, and can be covered by a transparent plastic material or left uncovered. Whether or not the window is covered will depend upon the product being packaged in the container. It may be desirable to prevent prospective purchasers from touching the product prior to purchase; for instance, in packaging dolls or vases. On the other hand, it may be desirable to permit the prospective purchaser to better inspect the product in the container; for instance, in packaging a football.

When forming the window in such display containers, the section cut from the front of the container is usually discarded as waste material. In some cases, the cut-out section is cut in such a way that it is essentially two halves connected to the front of the container on either side of the window. The two halves are then folded inwardly against the inner surfaces of the side walls of the container to form a backdrop for the product to be displayed. By properly folding the backdrop about its connection to the front of the container, it could have the same finish as would the exterior surfaces of the container.

Of particular importance with respect to the invention to be described hereafter, conventional display containers, including those with windows, are typically formed from blanks which include material for forming the bottom or top of the container. FIG. 1 shows such a blank, the bottom panel of the container being generally designated as A. The cut-out section made to form the window of the container is generally designated as B. As shown in FIG. 1, the bottom panel A is connected to flaps below the cut-out section on the front of the octagonal container. When forming the box by folding the blank about the fold lines scored in the material, usually cardboard, the bottom panel A is folded into position to connect the front, back and sides of the container.

As FIG. 1 illustrates, the conventional design of display containers having windows therein is uneconomical as well as inefficient insofar as manufacturing is concerned. The cut-out section of material for forming the window is wasted while additional material is required to form the bottom of the container. Moreover, the box blank is made wider only for the purpose of including the bottom panel. In FIG. 1, compare the $x+x'$ dimension with the x dimension. Thus, the manufacturing, handling and storage of the box blanks prior to formation of conventional display containers has been further complicated by this design of the box blank.

Accordingly, the above shortcomings with respect to material waste and manufacturing efficiency warrant the redesign of the conventional display container. Thus, the present invention.

SUMMARY OF THE INVENTION

The present invention relates to a display container having a display window to display articles of manufacture held in the container. The display container in accordance with the present invention includes at least three panels to define an interior, and a bottom panel which is formed from a cut-out section partially cut from one of the panels, yet remains connected to at least one panel so that the cut-out section can be folded into the interior defined by the panels to thus form the bottom panel. The cut-out section could include a second fold line so that the bottom panel thus formed is disposed at the lower edges of the wall panels. The wall panels can also include end flaps and tabs to aid in securing the bottom panel at the lower edges thereof. The tabs of the wall panels can be inserted through slots in the bottom panel to not only lock the end flaps to the bottom panel but extend in a substantially vertical position to help support any article of manufacture which is held in the container. In this regard, the lengths of the end flaps and tabs can be varied as can the position of the slots in the bottom panel, so that the position of the vertically extending tabs in the assembled container can be varied depending upon the article of manufacture to be held therein. In the case where there is no fold line in the cut-out section except for the fold line at the connection between the cut-out section and at least one of the panels, the wall panels can include end flaps which are folded into the interior formed by the wall panels and connected to the inner surfaces of their respective walls. In this manner, the bottom panel can be at least partially supported on these end flaps. A method for making the box blanks in accordance with the structure of the above-described container is also described and claimed. A display carton with two windows can also be provided where the cut-outs to form the windows form the top and bottom panels of the display carton.

Accordingly, it is an object of the present invention to provide a display container having a window to expose the interior of the container, wherein the bottom panel of the container is formed by the material cut from the front of the container to form the window.

It is another object of the present invention to provide a display container as described in the preceding paragraph wherein the sides of the container include bottom retaining flaps to secure the bottom panel in position at the bottom of the container.

It is another object of the present invention to provide a display container including bottom retaining flaps on the sides of the container for securing he bottom panel and which includes stabilizing flaps for stabilizing a product displayed in the display container.

It is another object of the present invention to provide a display container where the bottom panel of the container is disposed at the end of the side walls.

It is yet another object of the present invention to provide a display container having a window cut from a section of the front of the display container wherein the cut section is folded into the interior of the display container to form the bottom panel of the display container, the bottom panel being above the lower edges of the side walls so that the display container and product therein is supported on the lower edges of the side walls, rather than directly on the bottom panel.

BRIEF DESCRIPTION OF THE DRAWINGS

The foregoing and other objects of the present invention will become apparent, as will a better understanding of the concepts underlying the present invention, by reference to the description which follows and refers to the accompanying drawings in which.

DETAILED DESCRIPTION OF THE INVENTION

Figure 1:
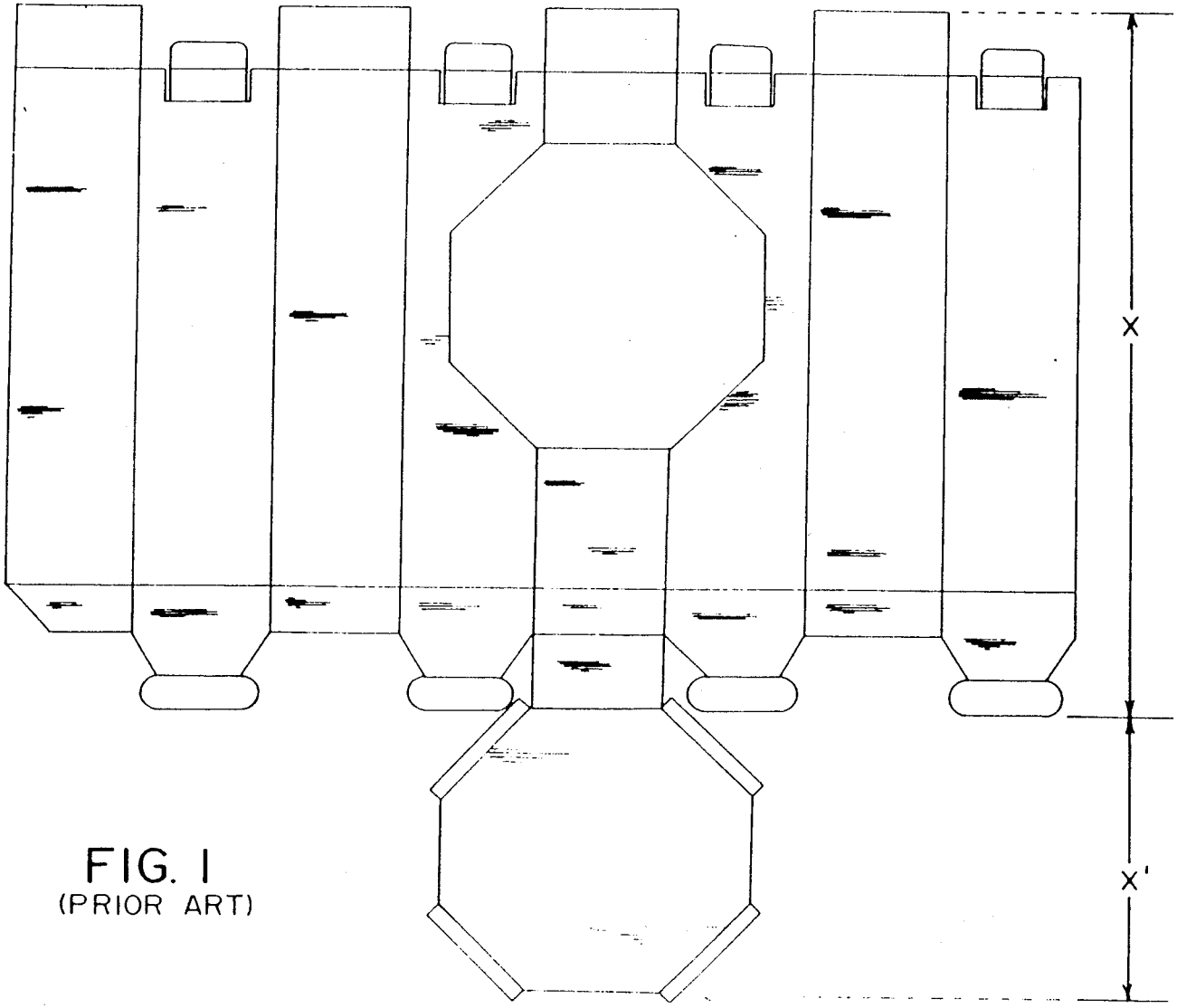
FIG. 1 (PRIOR ART)
FIG. 1 is a plan view of a box blank for forming a conventional display container having a window cut therein.
Figure 13:
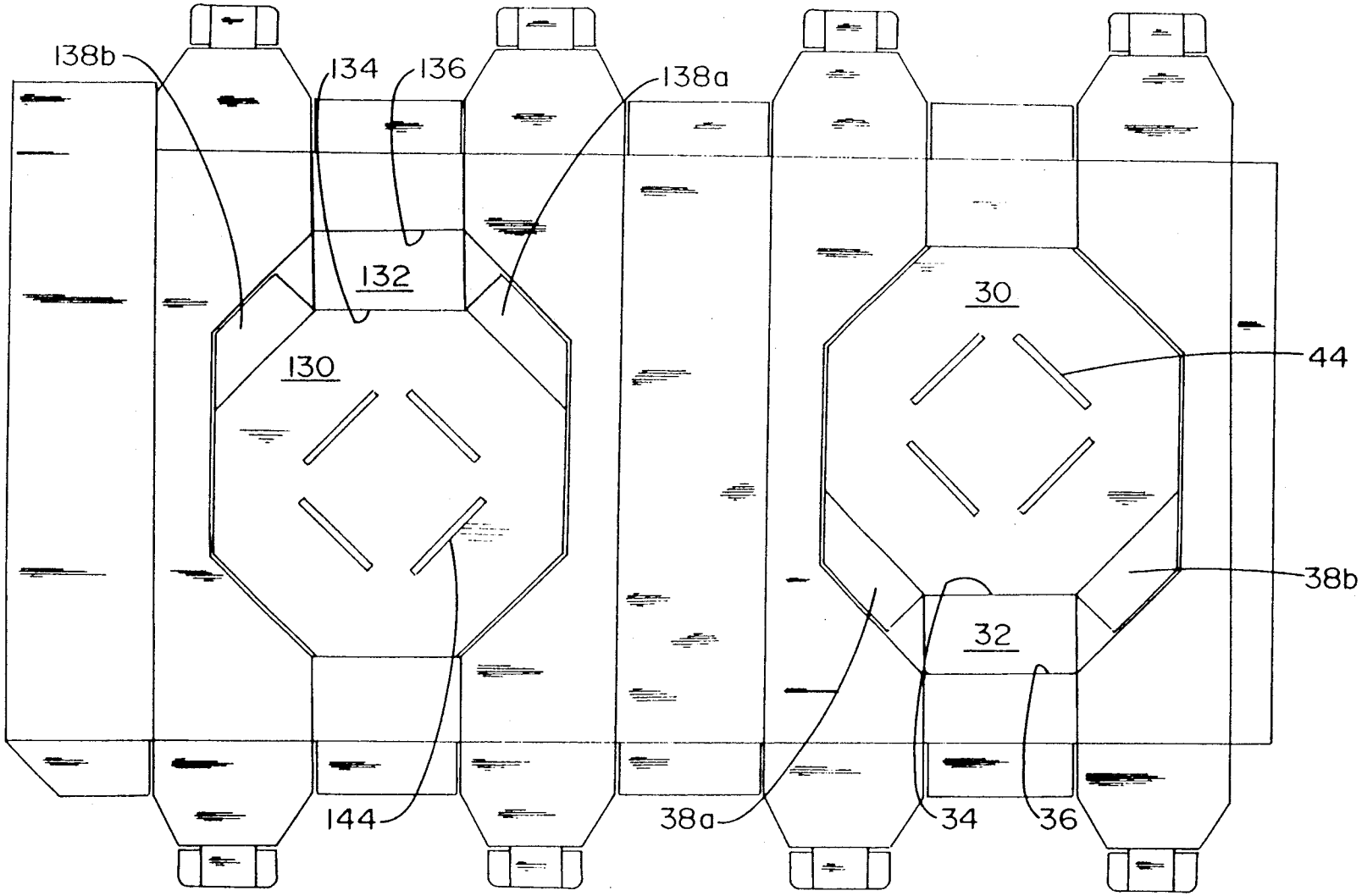
FIG. 13 is a plan view of a box blank for forming an octagonal display container in accordance with a third embodiment of the present invention, wherein said display container has two display windows.
Figure 14:
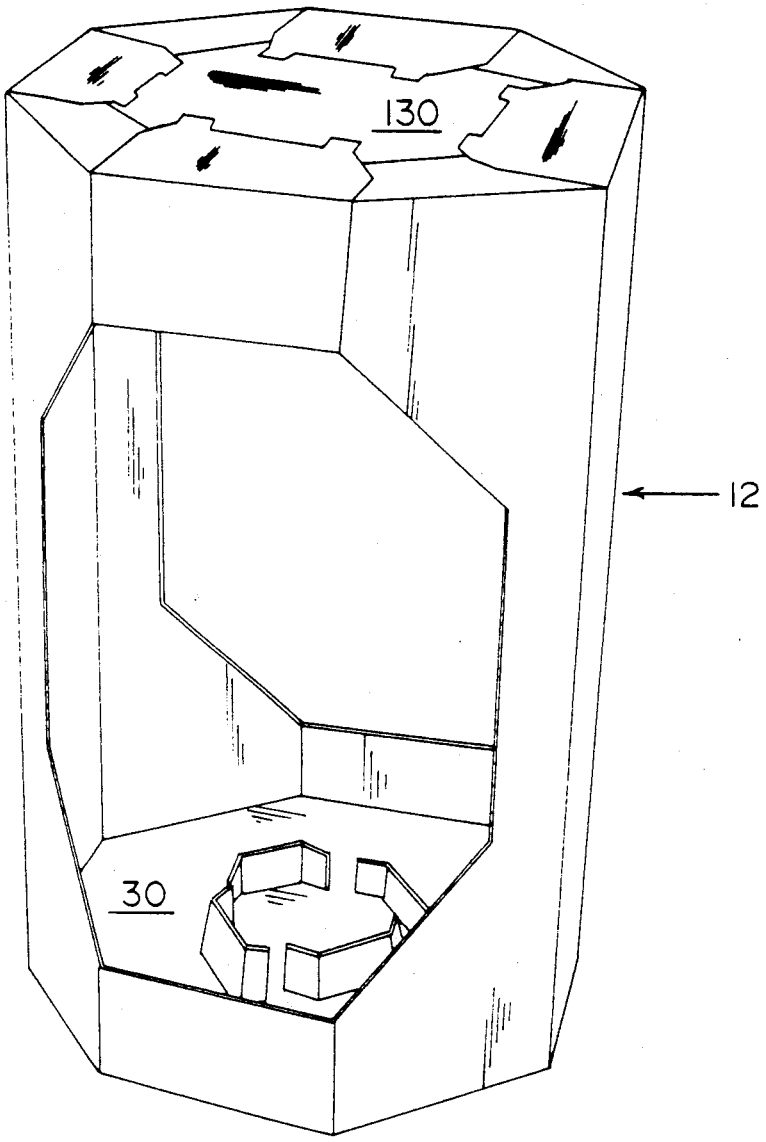
FIG. 14 is a perspective view of the display container in accordance with the third embodiment of the present invention, as formed by the box blank shown in FIG. 13.

Referring to the figures, FIG. 1 illustrates a prior art box blank for the formation of a display container, FIGS. 2–7 show one embodiment of a display container in accordance with the present invention and a method for forming the same, whereas FIGS. 8–12 show a second embodiment of a display container in accordance with the present invention and a method for forming the same. A third embodiment of the present invention is shown in FIGS. 13 & 14.

Figure 2:
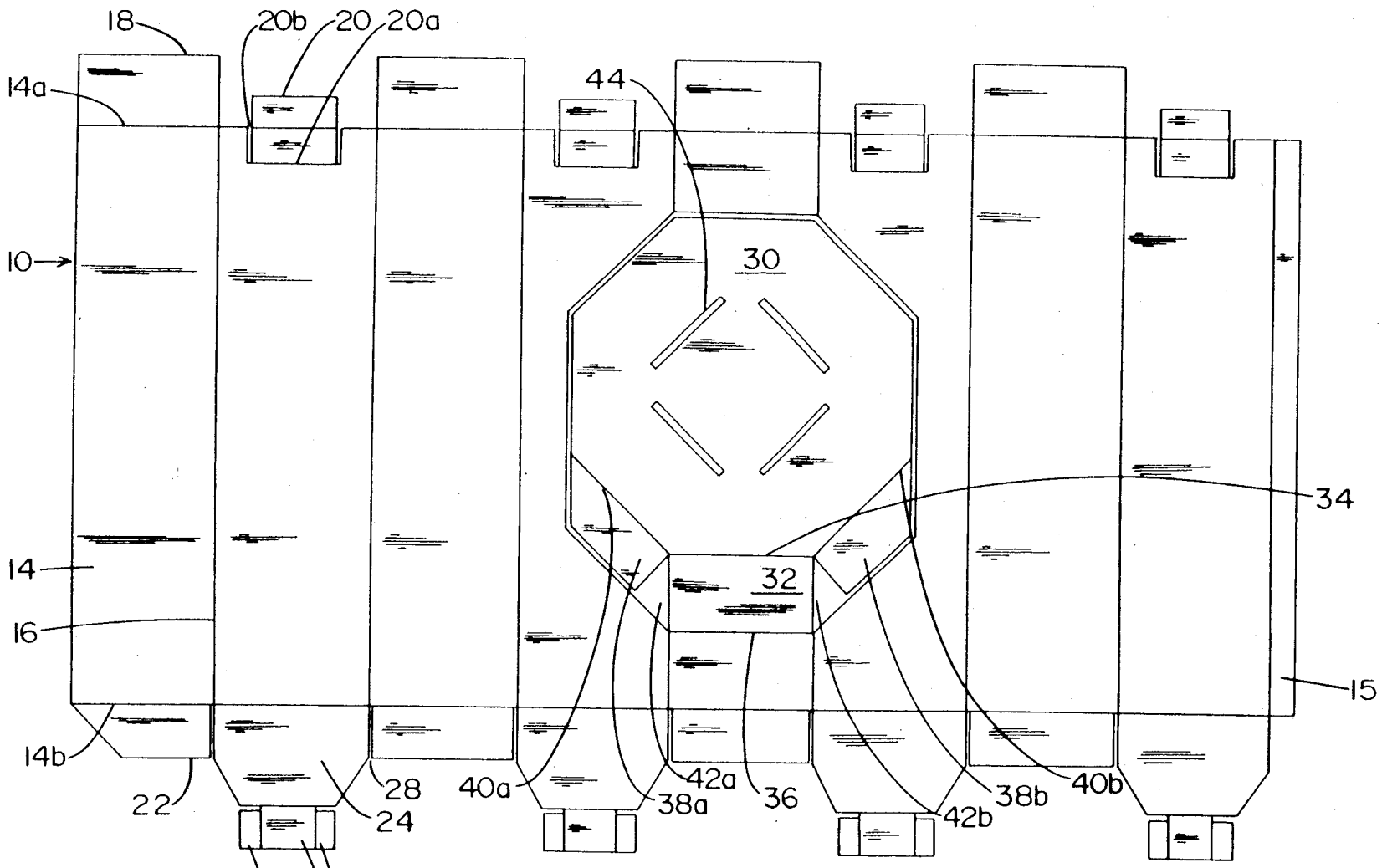
FIG. 2 is a plan view of a box blank for forming an octagonal display container in accordance with the present invention.

Thus, FIG. 2 shows a box blank generally designated as 10 in accordance with the present invention. This box blank 10 is adapted to be folded to form the display container generally designated as 12 in FIG. 3. It is noted that the conventional display container showed in FIG. 1 is also adapted to form a display container which is substantially identical in appearance to the display container 12. The differences between any display container formed by the box blank in FIG. 1 as compared with display container 12 will become apparent from the following.

The box blank 10 is thus adapted to form an octagonally shaped display container—that is, a display container having eight side walls or panels, generally designated as 14 and being separated by longitudinal fold lines 16. Since the preferred material for the display container in accordance with the present invention is cardboard, paper board, or the like, the longitudinal fold lines 16 are formed creasing or grooving the material in the portions to be folded. These fold lines are shown in the drawings by a heavier line than would be a cut portion or an edge. It is also preferred that the side of the box blank 10 which will form the outer surface of the display container 12 be finished aesthetically. A smooth and printable surface is desired. This can be obtained by painting or providing a paper laminate.

Figure 3:
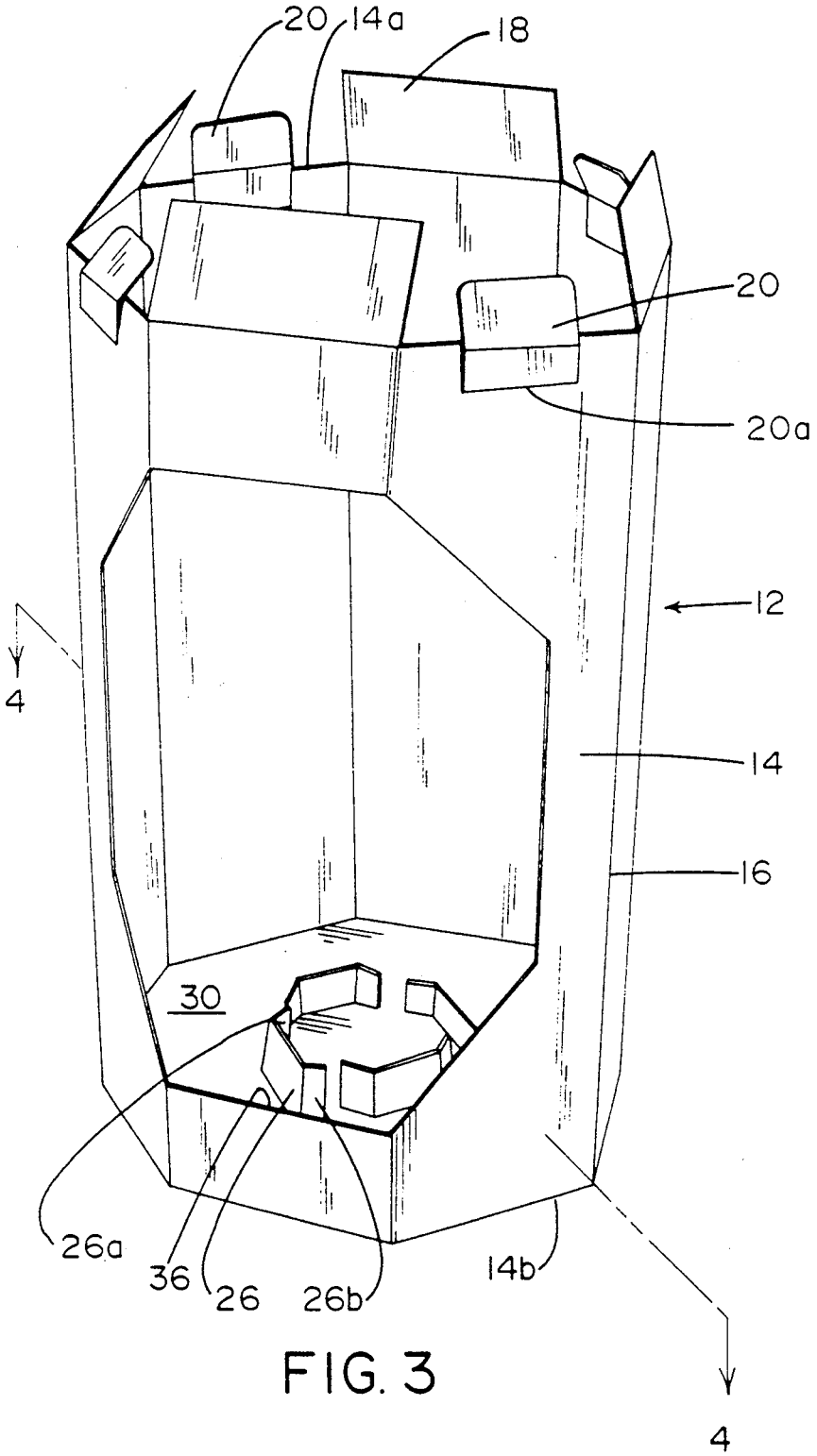
FIG. 3 is a perspective view of display container in accordance with the present invention as formed by the box blank in FIG. 2.

On the upper edge **14*a* of alternate wall panels 14 is an upper flap 18. Upper flap 18 is connected to wall panel 14 and is foldable at the upper edge 14*a* to facilitate the covering of the display container 12 with a top panel (not shown in this embodiment). The top panel adapted to fit the display container 12 is manufactured separately from the box blank in this and the next embodiment. The top panel could very well be adapted to be part of the box blank 10 either in the conventional manner shown in FIG. 1 or the manner shown in FIG. 13 in accordance with the present invention. This will be discussed in conjunction with the third embodiment of the present invention. On the wall panels 14 which do not include an upper flap 18, an upper tuck tab 20 is provided. The upper tuck tab 20 is also foldable at or substantially at the upper edge 14*a* of the wall panels 14 so that it can be tucked into a slot in a top panel. Each upper tuck tab 20 is also foldable at fold line 20*a* just below and generally parallel to the upper edge 14*a*. Coextensive with the ends of each upper tuck tab 20 are slits 20*b* which meet the fold line 20*a* at either end thereof on the respective wall panel 14. These slits 20*b* enable the upper tuck tabs 20 to be manipulated so they can be tucked into slots in a top panel. Reference to FIG. 3 shows that the upper tuck tabs 20 can be folded inwardly at upper edge 14*a* and outwardly at fold line 20*a* so that the upper tuck tab 20 can be moved from the vertical plane coextensive with the respective wall panels 14**, and ultimately to in a generally horizontal position for insertion into a slot in the top panel.

Figure 6:
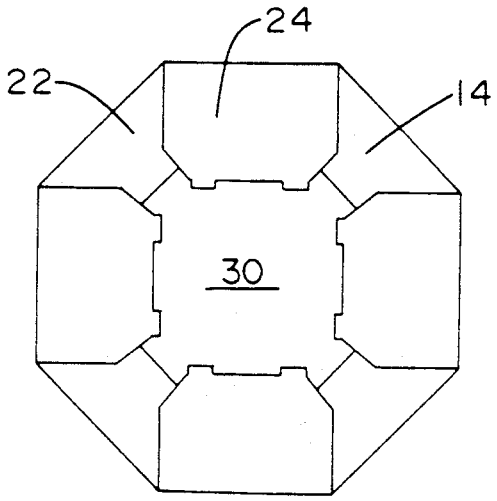
FIG. 6 is a bottom plan view of the display container shown in FIG. 3.

At the lower edge **14*b* of alternate wall panels 14 are lower flaps 22, which are adapted to be folded inwardly below the bottom panel of the display container 12. Alternately on the other wall panels 14 are extensions 24, also foldable about the lower edge 14*b*. At the end of each extension 24 is a lower tuck tab 26, each of which has locking tabs 26*a* and 26*b*. The locking tabs 26*a* & 26*b* are foldable as shown in FIG. 3 to lock the bottom panel of the display container 12 in place. This will be explained further below. It is also noted that the lower flaps 22 and extensions 24 are separated by cut lines 28 so that they are separately foldable into a generally horizontal position. As shown in FIG. 6, the lower flaps 22 are folded first so that they are partially covered by the extensions 24 when the display container 12** is in assembled condition.

The bottom panel 30 of the display container 12 is cut from three wall panels 14 (or front of the container) in accordance with this embodiment of the present invention. In FIG. 2 it can be seen that the bottom panel 30 is cut from the wall panels 14 such that the display window to be formed thereby is an elongate octagonal shape. This is necessary with respect to this embodiment because the inventive concepts underlying this embodiment of the present invention require that the bottom panel 30 remain connected to at least one wall panel 14. Thus, connection flap 32 is provided between the bottom panel 30 and the wall panels 14. As can be seen in FIG. 2, on the upper side of the connection flap 32 is a bottom panel fold line 34; and on the lower side of the connection flap 32 is a front fold line 36. The manipulation of these fold lines to move the bottom panel 30 in position at the lower edges **14*b* of the wall panels 14** will be discussed further below.

Figure 4:
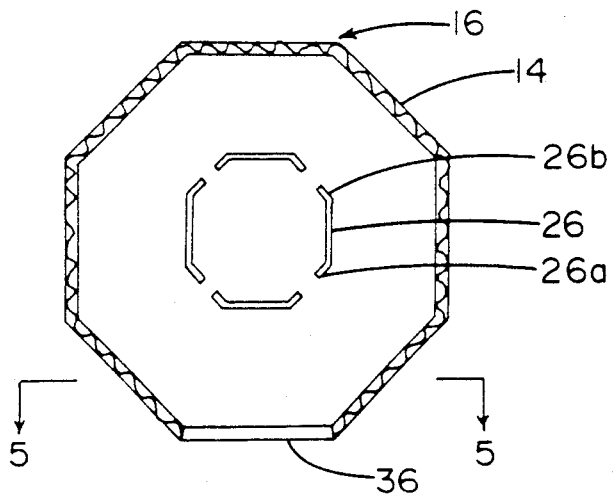
FIG. 4 is a sectional view of the display container in accordance with the present invention as taken along line 4—4 in FIG. 3, showing in particular the bottom panel of the display container.
Figure 5:
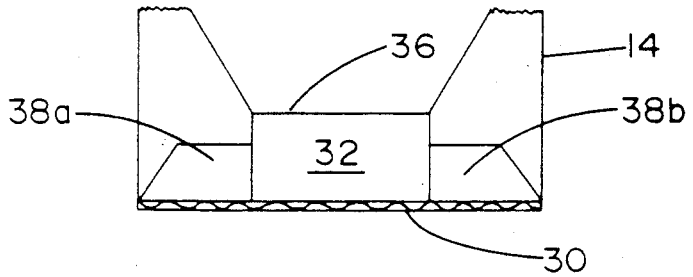
FIG. 5 is a sectional view of the display container in accordance with the present invention as taken along line 5—5 in FIG. 4, illustrating in particular the connection flap between the bottom panel and the front of the display container.

The bottom panel 30 also includes tension flaps **38*a* & 38*b*. These tension flaps 38 are connected to the bottom flap 30 at fold lines 40*a* & 40*b*. The fold lines 40*a* & 40*b* together with the bottom panel fold line 34 and the cut portions surrounding the bottom panel 30 form the shape of the display container 12, as can be seen in FIGS. 4 and 6. Between the tension flaps 38*a* & 38*b* are cutouts 42*a* & 42*b*. Removing the material in this area to form the cutouts 42*a* & 42*b* facilitates the easy manipulation of the bottom panel 30 when being folded into assembled position. Accordingly, the tension flaps 38*a* & 38*b* are to be folded upwardly so that they engage the inner surfaces of their respective wall panels 14, as shown in FIG. 5. This configuration helps maintain the bottom panel 30 in the substantially horizontal position as the tension flaps 38*a* & 38*b*** tend to push the bottom panel against the opposite wall panels.

Bottom panel 30 also includes four slots 44 cut therefrom for receiving the lower tuck tabs 26 of the wall panels 14 when the lower tuck tabs 26 are folded into a generally vertical position, as shown in FIG. 3. Once the lower tuck tabs 26 are through their respective slots 44, the locking tabs **26*a* & 26*b* of each lower tuck tab 26 can be folded slightly inwardly to lock the lower tuck tabs 26 in place. This, in effect, locks the bottom panel 30 in position at the lower edge 14*b* of the wall panels 14. In this position, the lower tuck tabs 26 form a support area for receiving the article of manufacture to be held and displayed in the display container 12. Thus, the lower tuck tabs 26** will aid in supporting the article of manufacture, for instance, the base of a lamp.

In accordance with the desire to provide such a support area, the length of the extensions 24 and the positioning of the slots 44 can be varied so that different articles of manufacture, that is, ones having differently sized bases, can be supported in a given embodiment of the display container 12.

Attached to one of the end wall panels 14 is a connection panel 15. The connection panel 15 is provided to connect the two end panels when the box blank 10 is folded into the octagonal shape shown in FIG. 3. The connection panel is adapted to be fastened to the opposite end panel by glue or other means. In assembled condition, the connection panel 15 will be on the interior of the display container 12.

Figure 7:
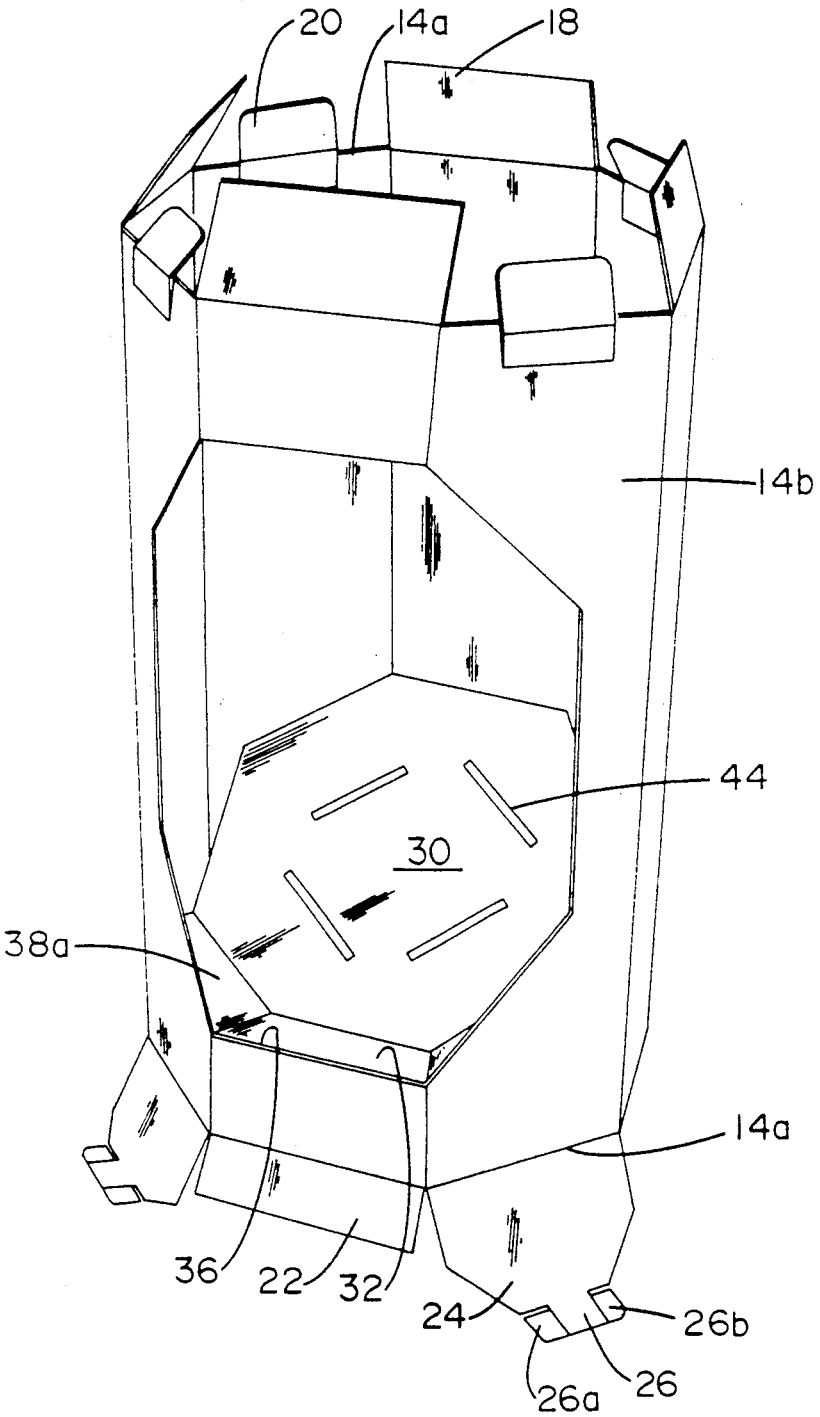
FIG. 7 is a perspective view of the box blank shown in FIG. 2 as it is being folded to form the display container shown in FIG. 3, illustrating in particular the folding of the bottom panel into the interior of the display container.
Figure 8:
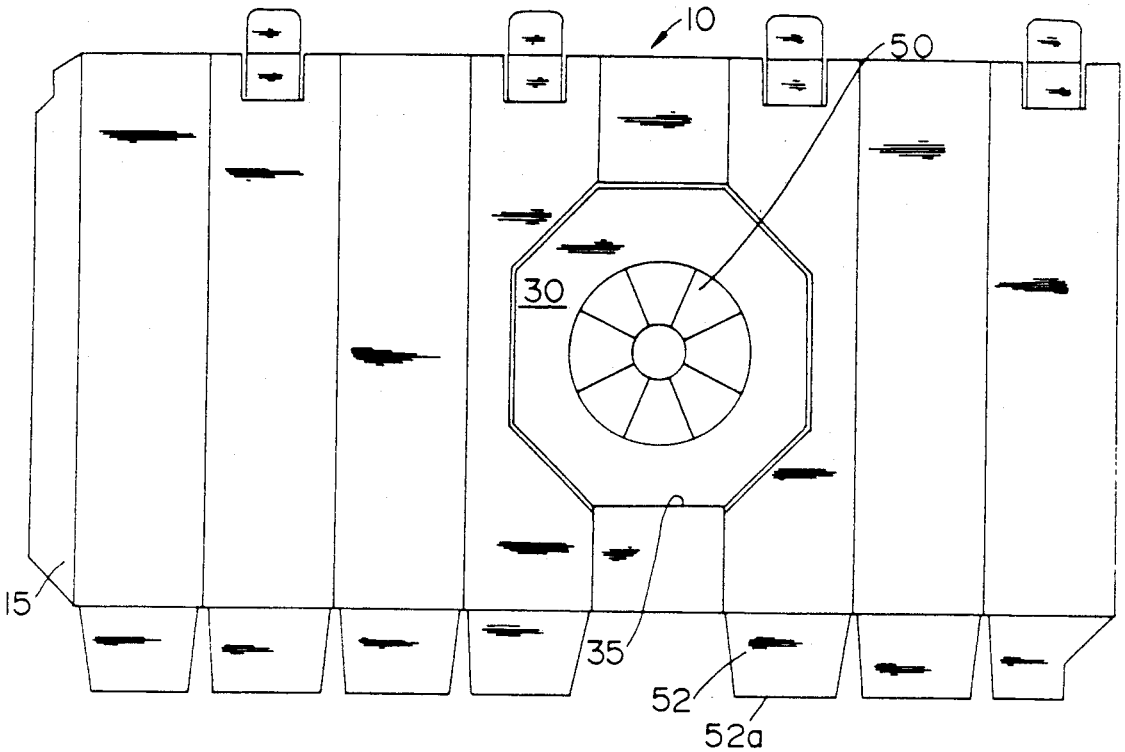
FIG. 8 is a plan view of a box blank for forming an octagonal display container in accordance with a second embodiment of the present invention.

Referring to FIG. 7, it can be seen that once the wall panels 14 are folded or substantially folded to form an octagonal shape, the bottom panel 30 can be folded into the interior formed by the wall panels 14. Thus, the connection flap 32 would be folded inwardly about front fold line 36 so that the connection flap 32 is moved towards the inner surface of the respective wall panel 14. Ultimately, the connection flap 32 will be in juxtaposition with its respective wall panel 14, while the connection at the front fold line 36 is maintained. Simultaneously, the bottom panel is folded about the bottom panel fold line 34 so that it is in a generally horizontal position at the lower edges **14*b* of the wall panels 14**.

The lower flaps 22 can then be folded against the bottom panel 30, and subsequently, the extensions 24 can be folded over the lower flaps 22. Of course, as described above, lower tuck tabs 26 are inserted through the slots 44 in the bottom panel 30, and locking tabs **26*a* & 26*b* can be folded to lock the bottom panel 30 in position at the lower edges 14*b* of the wall panels 14**.

FIG. 5 shows the manner in which the connection flap 32 is folded against the inside of its respective wall panel 14, and the tension flaps **38*a* & 38*b* are folded against the inside of their respective wall panels 14**.

A second embodiment of the present invention is shown in FIGS. 8–12. It is noted that in these figures, elements and features from the first embodiment have the same reference numerals as used in the previous figures.

Thus, the primary difference between the first embodiment and this second embodiment is the lack of a connection flap 32 so that the bottom panel 30 is disposed in a generally horizontal position at the bottom of the display window—not at the lower edges **14*b* of the wall panels 14. The bottom panel 30 is cut from the wall panels 14 in the same shape formed by the wall panels 14 when folded to form an interior. In other words, the same octagonal shape formed by the wall panels 14 is cut to form the bottom panel 30. An elongate octagonal shape and size is not required. Further, an object support section 50 is cut and scored in the bottom panel 30 so that the bottom panel 30** can hold an article of manufacture such as a football.

Figure 9:
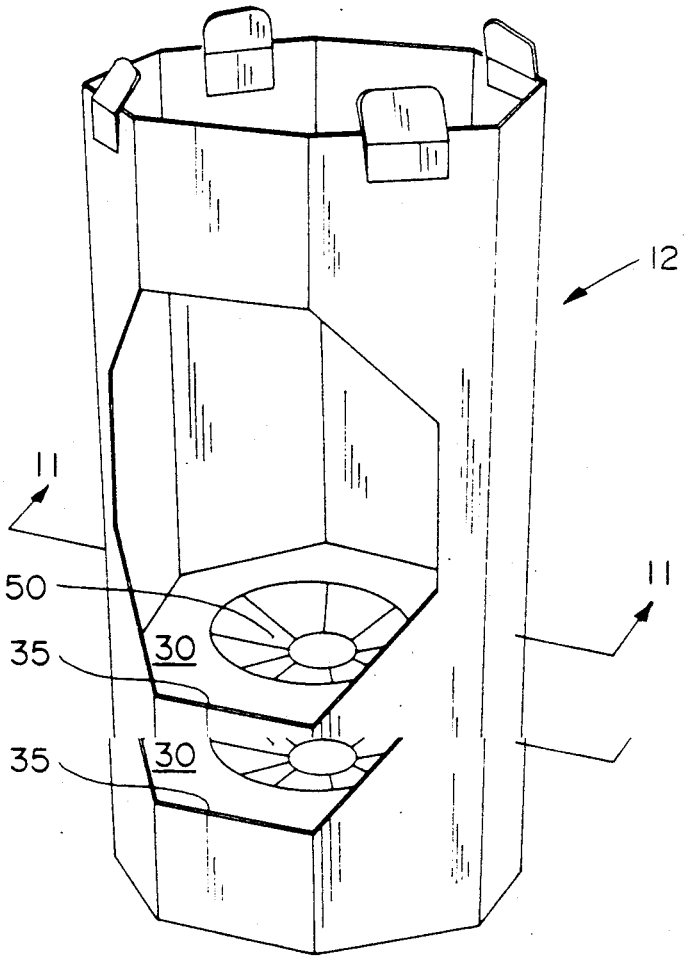
FIG. 9 is a perspective view of the display container in accordance with the second embodiment of the present invention, as formed by the box blank shown in FIG. 8.
Figure 10:
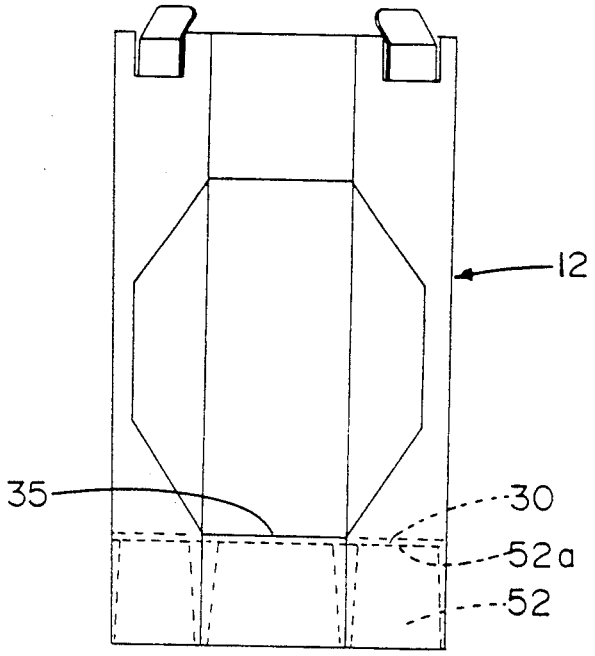
FIG. 10 is a front elevational view of the display container shown in FIG. 9.
Figure 11:
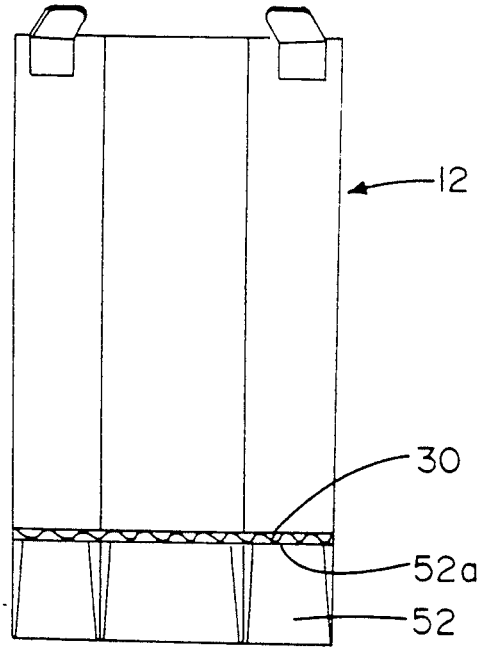
FIG. 11 is a sectional view of the display container as taken along line 11—11 in FIG. 9, illustrating in particular the lower flaps of the side walls of the container as folded upwardly against the interior of the side walls to support the bottom panel.

In this embodiment, support for the bottom panel 30 is provided by support flaps 52 which are folded into the interior formed by the wall panels 14. The support flaps 52 are fastened, by glue or otherwise, to the inner surfaces of the wall panels 14 so that the edges **52*a* of the support flaps 52 form shoulders on which the bottom panel 30 is supported. FIG. 11, a section taken on line 11—11 of FIG. 9 shows the support provided by the support flaps 52**.

Figure 12:
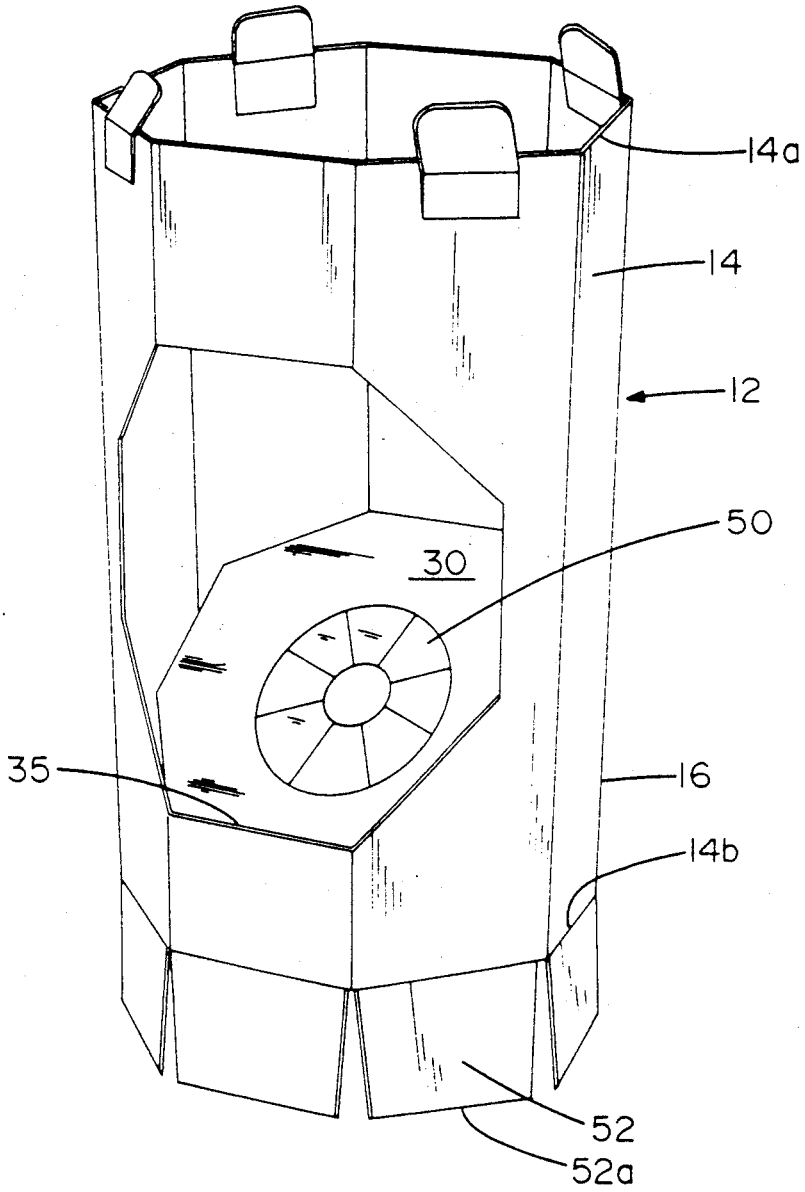
FIG. 12 is a perspective view of the box blank shown in FIG. 8 as it is being folded to form the display container shown in FIG. 9.

FIG. 12 shows the display container 12 in accordance with the second embodiment of the present invention as the bottom panel 30 is being folded inwardly about the window fold line 35 to a generally horizontal position at the bottom of the display window. Of course, if it is desired to present the article of manufacture in a different position, the bottom panel 30 need not be horizontal, but could be disposed on an upward angle or downward angle starting from the bottom of the display window. In this embodiment, of course, the support flaps 52 on certain wall panels 14 would have to be longer to support the bottom panel 30 at the back of the display container 12.

A third embodiment of the present invention is shown in FIGS. 13 and 14, and is quite similar to the first embodiment, but for the presentation of two display windows generally opposite from one another in the display container. The advantage to this embodiment is that the article of manufacture is presented from both sides of the container, depending on the size of the windows and shape of the container. Another advantage is that of material savings and efficiency since the second window can be formed by a cut-out section used to also form the top panel 130. The formation of the top panel 13 is identical to the formation of the bottom panel 30, but is on the other side of the box blank, as shown in FIG. 13, so that it appears on the reverse side of the container, when the box blank is assembled, as shown in FIG. 14. The other difference would be that the lower flaps and extensions connected to the lower edges 14*b* of the wall panels 14 would also be provided at the upper edge 14*a* of the wall panels 14 so that the top panel 130 can be secured in place as was the bottom panel 30.

Accordingly, on the left side of the box blank shown in FIG. 13, the top panel 130 includes slots 144, tension flaps 138*a* & 138*b*, a connection flap, a rear fold line 136 and a top panel fold line 134.

Thus, in this third embodiment of the present invention even more material is saved as a top panel need not be made for the display container.

While the foregoing description and figures illustrate the preferred embodiment of the display container in accordance with the present invention, it should be appreciated that certain modifications can be made and are encouraged to be made in the structure of the disclosed embodiments without departing from the spirit and scope of the present invention which is intended to be captured by the claims set forth immediately below.

What is claimed is:

1. A display container for holding and displaying articles of manufacture, said container comprising a front, side, a back, a bottom panel between said front, sides and back, and a top panel opposite said bottom panel and between said front, sides and back, said front, sides and back defining an interior, said bottom panel being formed from a cut-out section partially cut from and connected to at least said front, said cut-out section having been folded into said interior to thereby form said bottom panel and a front display window exposing said interior, said top panel being formed from a second cut-out section partially cut from and connected to at least said back, said cut-out section having been folded into said interior to thereby form said top panel and a back display window exposing said interior.

2. The display container in claim 1, wherein said bottom panel is connected directly to said front by a front fold line, said bottom panel being folded into said interior such that said bottom panel is disposed at a substantially horizontal position at the bottom of the said front display window.

3. The display container in claim 2, wherein said front, sides and back include end flaps which have been folded into said interior so that said bottom panel can rest thereon.

4. The display container in claim 1, including a back connection flap being connected to said back and said top panel, said back connection flap having been folded into said interior so that it is in juxtaposition with and substantially parallel with said back, said top panel being disposed in a substantially horizontal position at the upper edges of said front sides and back.

5. A display container for holding and displaying articles of manufacture, said container comprising a front, sides, a back, and a substantially horizontal bottom panel between said front, sides and back, said front, sides and back defining an interior, said bottom panel being formed from a cut-out section partially cut from and connected to at least said front, said cut-out section having been folded into said interior to thereby form said bottom panel and a front display window exposing said interior, and a front connection flap being connected to said front and said bottom panel, said front connection flap having been folded into said interior so that it is in juxtaposition with and substantially parallel with said front, and wherein said front, sides and back include end flaps which have been folded into a substantially horizontal position below said bottom panel, said bottom panel having slots, and at least a portion of said end flaps have tabs extending through said slots in said bottom panel and into said interior in a substantially vertical position.

6. A box blank for forming a display container having at least two display windows, said box blank comprising, a sheet of foldable material having at least first, second and third panels defined by fold lines in a first direction, a first cut-out section partially cut from at least said first panel, said cut-out section remaining connected to at least said first panel, said first, second and third panels being adapted to be folded together to form an interior, said first cut-out section being adapted to be folded into that interior to thereby form a bottom panel for a display container, while leaving a first display window in at least said first panel of the display container, and a second cut-out section partially cut from at least said second panel, said second cut-out section remaining connected to at least said second panel, said second cut-out section being adapted to be folded into the interior to thereby form a top panel for the display container, while leaving a second display window in at least said second panel of the display container.

7. A box blank for forming a display container having a display window, said box blank comprising, a sheet of foldable material having at least first, second and third panels defined by fold lines in a first direction, a cut-out section partially cut from at least said first panel, said cut-out section remaining connected to at least said first panel by a connection panel between two fold lines, said first, second and third panels being adapted to be folded together to form an interior and in such form have lower edges, said cut-out section being adapted to be folded into that interior to thereby form a bottom panel for a display container such that the bottom panel is positioned at the lower edges of the first, second and third panels, wherein at least a portion of said first, second and third panels include end flaps, and said end flaps include tabs, said cut-out section having slots cut therethrough, said end flaps being adapted to be folded into a substantially horizontal position below the bottom panel formed by said cut-out section, and said tabs being adapted to be inserted through said slots of said cut-out section so that they extend into said interior in a substantially vertical position whereby they can at least partially support an article in the display container.

8. A method of making a box blank foldable to form a display container having two display windows, said method comprising the steps of providing a sheet of foldable material, forming at least three fold lines to thereby define at least first, second and third wall panels and one wall flap for connecting said first, second and third wall panels to form an interior, partially cutting a cut-out section from said first wall panel to thereby leave an uncut portion, and forming at the uncut portion a fold line between the cut-out section and said first wall panel, cutting a second cut-out section from said second wall panel to thereby leave a second uncut portion, and forming at the second uncut portion a fold line between the second cut-out section and said second wall panel.

9. A method of making a box blank foldable to form a display container having a display window, said method comprising the steps of providing a sheet of foldable material, forming at least three fold lines to thereby define at least first, second and third wall panels and one wall flap for connecting said first, second and third wall panels to form an interior, said first, second and third wall panels having lower edges when so formed, partially cutting a cut-out section from said first wall panel to thereby leave an uncut portion, forming at the uncut portion a fold line between the cut-out section and said first wall panel, forming a second fold line in said cut-out section, said second fold line being substantially parallel to said first fold line so that said cut-out section can be folded into the interior formed by said first, second and third wall panels to thereby form a bottom panel positioned at the lower edges of said wall panels, forming end flaps at the lower edges of at least a portion of said first, second and third wall panels, and forming tabs on the end flaps so that when the first, second and third wall panels are folded to form an interior and the cut-out section is folded to form the bottom panel, the end flaps can be folded into a substantially horizontal position below the bottom panel and the tabs can be inserted through the slots so that they can extend substantially vertically into the interior of the assembled container.

* * * * *

UNITED STATES PATENT AND TRADEMARK OFFICE

CERTIFICATE OF CORRECTION

PATENT NO. : 5,011,070

DATED : April 30, 1991

INVENTOR(S) : Robert L. Plunkett

It is certified that error appears in the above-identified patent and that said Letters Patent is hereby corrected as shown below:

Column 2, Line 54, "he" should read --the--

Column 5, Line 18, "panels" should read --panel--

Column 7, Line 12, "13" should read --130--

Signed and Sealed this

First Day of December, 1992

*Attest:*

DOUGLAS B. COMER

*Attesting Officer*

*Acting Commissioner of Patents and Trademarks*